US005971170A

United States Patent [19]

Livingston

[11] Patent Number: 5,971,170

[45] Date of Patent: Oct. 26, 1999

[54] CLOTHES DRYING RACK

[76] Inventor: Edwin Earl Livingston, 47 Schneider Rd., Cody, Wyo. 82414

[21] Appl. No.: 09/027,457

[22] Filed: Feb. 21, 1998

[51] Int. Cl.[6] ..... A47F 5/08

[52] U.S. Cl. ..... 211/116

[58] Field of Search ..... 211/116, 113, 211/119.01, 170, 171, 104

[56] References Cited

U.S. PATENT DOCUMENTS

| | | |
|---|---|---|
| 23,460 | 4/1859 | Fletcher . |
| D. 113,517 | 2/1939 | Mendle . |
| D. 136,003 | 7/1943 | Aaronson . |
| 968,240 | 8/1910 | Gale . |
| 1,516,091 | 11/1924 | Gordon . |
| 2,312,803 | 3/1943 | Curtenius . |

*Primary Examiner*—Alvin Chin-Shue
*Assistant Examiner*—Sarah Purol
*Attorney, Agent, or Firm*—Risto A. Rinne, Jr.

[57] ABSTRACT

An apparatus for drying clothes is attached to a ceiling and includes a first planar member that is mounted to the ceiling. Four members are pivotally attached, each about an axis at one end to the first planar member and are pivotally attached, each about an axis at an opposite end to a second planar member. Each of the eight axes are parallel with respect to each other. The second planar member is maintained in a parallel relationship with respect to the first planar member and is able to pivot in an arc thereto until contact is made. A latching mechanism is attached to the first planar member and also to the second planar member which secures the second planar member in position adjacent to the first planar member. A handle is attached to the second planar member and is used to urge the second planar member either toward or away from the first planar member. A clothes receiving rack is detachably attached to the second planar member and is adapted to receive clothes thereon for air drying.

20 Claims, 1 Drawing Sheet

CLOTHES DRYING RACK

BACKGROUND OF THE INVENTION

1. Field of the Invention

The present invention, in general relates to clotheslines and, more particularly, to ceiling-mounted retractable clothes drying racks.

There is clearly a need for a clothes drying rack that can be used indoors that does not take up valuable living space when it is not needed. Ideally it should retract overhead and can be installed in laundry rooms, possibly directly over the washing machine and clothes dryer.

It should be easy to use and easy to install being readily mountable to overhead ceiling joists or roof trusses. It should be inexpensive to manufacture and reliable to use. It should be attractive in appearance as well.

It should also lend itself to current manufacturing processes and, accordingly, be manufacturable from various materials including plastics. Ideally it should provide an attachment plane that permits the attachment of various size and shape racks thereto.

Clearly, such an apparatus is a useful and desirable device.

2. Description of Prior Art

Clotheslines and racks are, in general, known. For example, the following patents describe various types of these devices:

U.S. Pat. No. 23,460 to Fletcher, Apr. 5, 1859;

U.S. Pat. No. 968,240 to Gale, Aug. 23, 1910;

U.S. Pat. No. 1,516,091 to Gordon, Nov. 18, 1924;

U.S. Pat. No. 2,312,803 to Curtenius, Mar. 2, 1943;

U.S. Pat. No. D113,517 to Mendle, Feb. 28, 1939;

U.S. Pat. No. D136,003 to Aaronson, Jul. 20, 1943; and

U.S. Pat. No. D255,315 to Koshiyama, Jun. 10, 1980.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a clothes drying rack that can be used indoors.

It is also an important object of the invention to provide a clothes drying rack that is ceiling mounted.

It is another object of the present invention to provide a clothes drying rack that includes a latch to maintain the rack in a retracted position.

Another object of the invention is to provide a clothes drying rack that can be used with ceilings as low as seven feet high.

Still another object of the invention is to provide a clothes drying rack that can be pulled down for use and which can retract up and out of the way when not in use.

Still yet another object of the invention is to provide a clothes drying rack that can be mounted over a clothes dryer or clothes washing machine.

Yet another important object of the invention is to provide a clothes drying rack that includes a first planar member that is adaptable for mounting to overhead ceiling joists or roof trusses.

Still yet another important object of the invention is to provide a clothes drying rack that is inexpensive to manufacture.

Yet one other object of the invention is to provide a clothes drying rack that is attractive in appearance.

Yet one other important object of the invention is to provide a clothes drying rack that can be made of plastic.

Yet one other especially important object of the invention is to provide a clothes drying rack that includes a second planar member that remains in a parallel orientation with respect to the first planar member whether the rack is extended for use or retracted for storage and having the second planar member adapted for attachment of a clothes drying rack thereto.

Still yet one remaining especially important object of the invention is to provide a clothes drying rack that retracts as close to the ceiling as possible.

A further stated important object of the invention is to provide a clothes drying rack that can accept clothes receiving racks having different sizes and shapes.

Briefly, a clothes drying apparatus for use indoors that is constructed in accordance with the principles of the present invention includes a first planar member for attachment to a pair of ceiling joists or roof trusses. Preferably four members, but minimally at least three members, are each pivotally attached to the first planar member at one end thereof and are each pivotally attached to a second planar member at the remaining end. The second planar member includes means for mounting a clothes receiving rack thereto and includes a handle useful for pulling the clothes receiving rack down from the ceiling into a position convenient for use or to retract it back up to the ceiling.

DETAILED DESCRIPTION OF THE INVENTION

Figure 1:
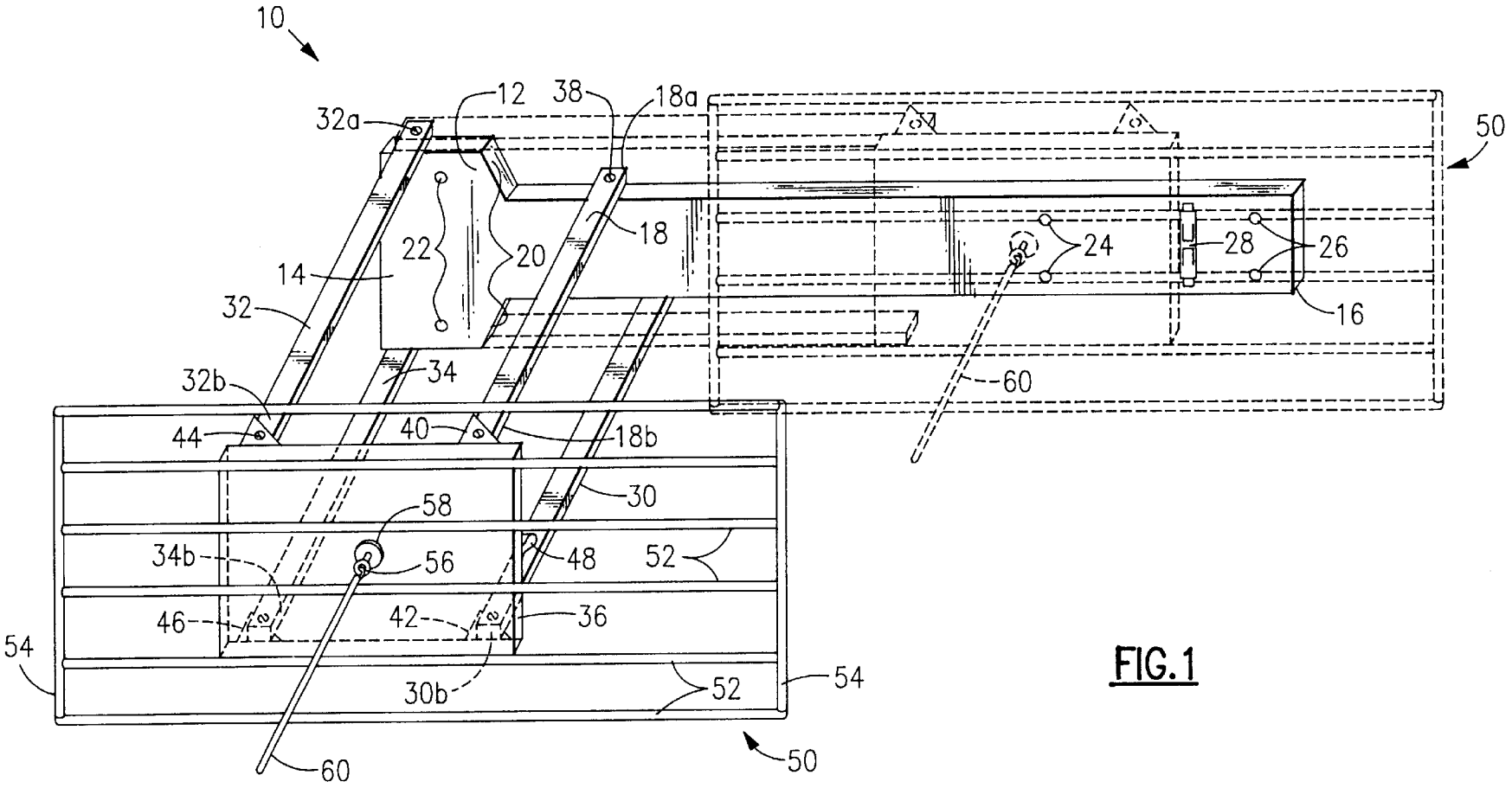
FIG. 1 is a view in perspective of a clothes drying rack shown in a first extended position ready for use, and in dashed lines, in a second retracted position.

Referring to FIG. 1 is shown, a clothes drying rack, identified in general by the reference numeral 10.

A first planar member 12 includes a first end 14 and an opposite second end 16. The first end 14 is wider than the second end 16 by at least two times the width of a first member 18, to allow for the rack 10 to retract compactly, as is discussed in greater detail hereinafter.

The first planar member 12 is generally flat with a length from the first end 14 to the second end 16 that is greater than its width. It is used as a base to attach other parts of the rack 10, as are described in greater detail hereinafter, thereto and also to attach the rack 10 to a structure, as is also described in greater detail hereinafter.

A taper 20 is disposed near the first end 14 to reduce the width of the first planar member 12 from that of the first end 14 to that of the second end 16.

A first pair of mounting holes 22 are provided near the first end 14, and are used to attach the rack 10 to a first ceiling joist (not shown) or to a first roof truss (not shown) by inserting a first pair of screws (not shown) through the first pair of mounting holes 22 and tightening them accordingly. The screws will, of course, pass through any material, such as sheetrock (not shown) or drywall (not shown) intermediate the first planar member 12 and the joist or truss.

A second pair of mounting holes 24 are provided disposed a predetermined distance away from the first pair of mounting holes 22, and are used to attach the rack 10 to a second ceiling joist (not shown) or to a second roof truss (not shown) by inserting a second pair of screws (not shown) through the second pair of mounting holes 24 and tightening them accordingly.

Typically the second pair of mounting holes 24 are disposed sixteen inches away from the first pair of mounting holes 22 to align with a standard sixteen inch spacing intermediate the first and second joist or first and second roof truss. Of course, if necessary, other means such as a pair of molly bolts (not shown) may be used to secure the first planar member 12 to the structure with four special screws (not shown) passing through the first and the second pair of mounting holes 22, 24 respectively, or alternatively, through a third pair of mounting holes 26.

The third pair of mounting holes 26 are disposed a predetermined distance away from the first pair of mounting holes 22, and are used to attach the rack 10 to an alternate ceiling joist (not shown) or to an alternate roof truss (not shown) by inserting a third pair of screws (not shown) through the third pair of mounting holes 26 and tightening them accordingly.

Typically the third pair of mounting holes 26 are disposed sixteen inches away from the first pair of mounting holes 22 to align with a standard twenty-four inch spacing intermediate the first and alternate joist or first and alternate roof truss.

A first half of a mechanical latch 28 is disposed a predetermined distance away from the first end 14 and is attached to the first planar member 12.

Three additional members which are identified as a second, a third, and a fourth member and by the reference numerals 30, 32, and 34, respectively are formed essentially the same as that of the first member 18.

The first through the fourth members 18, 30, 32, 34 share certain attributes which are described for the first member 18 hereinbelow and which also refer, in general, to the second, third, and fourth members 30, 32, 34 as well. Any differences are noted thereafter.

A first member first end 18*a* of the first member 18 is pivotally attached to the first planar member 12. A first member second end 18*b* is disposed at the opposite end with respect to the first member first end 18*a* and is pivotally attached to a second planar member 36.

A mounting screw 38 passes through a hole (not shown) in the first member first end 18*a* and is attached to the first planar member 12. The first member 18 is free to pivot with respect to the first planar member 12 about a first axis that the mounting screw 38 provides. The first member second end 18*b* is attached to a first hinge 40 which, in turn, is pivotally attached to the second planar member 36 and is able to pivot with respect to the second planar member 36 about a second axis.

A second hinge 42, a third hinge 44, and fourth hinge 46 are attached to the respective second ends of the second member 30, the third member 32, and the fourth member 34 which, in turn, are each pivotally attached to the second planar member 36 and which also pivot about a respective third axis, fourth axis, and fifth axis.

It is noted that the first through the fourth members 18, 30, 32, 34 have in total eight opposite ends each of which is pivotally attached to either the first planar member 12 or to the second planar member 36 about one of eight axes in total. All of the eight axes, though disposed a predetermined distance apart from each other, are in parallel relation with respect to each other.

The first member 18 and the second member 30 differ from the third member 32 and the fourth member 34 as to where attachment occurs on the first planar member 12, and of course, on the second planar member 36. The first member 18 and the second member 30 are pivotally attached to the first planar member 12 intermediate the first end 14 and the second end 16 after the taper 20 has reduced the width of the first planar member 12 to that equal to the second end 16 thereof.

Both the third member 32 and the fourth member 34 are pivotally attached to the first planar member 12 near to the first end 14 thereof at a location prior to the taper 20 and therefore, at the widest part of the first planar member 12.

As is well known in the mechanical arts, three points are minimally needed to define a plane. Therefore, in combination, any three of the first through the fourth members 18, 30, 32, 34 may be used to similarly define a plane at both ends thereof by considering a point (not shown) in each of their three respective axes at both ends thereof. For clarity, the point as chosen is disposed along the center of each respective axis and also at the geometric center of the first through fourth members 18, 30, 32, 34.

The first member first end 18*a* being pivotally attached to the first planar member 12 mechanically defines this as one point of a first plane. Similarly any two first ends of the second, third, and fourth members 30, 32, 34 are needed to define the plane of the first planar member 12.

The first member second end 18*b* along with the second ends of any two of the second, third, and fourth members 30, 32, 34 are needed to define the plane of the second planar member 36.

Accordingly, any three of the first, second, third, and fourth members 18, 30, 32, 34 are used to define a first plane; that of the first planar member 12, and a second plane; that of the second planar member 36.

The first member 18 in combination with the third member 32 and the first planar member 12 and the second planar member 36 form a first "four-bar" mechanical type of a linkage, which defines a first parallelogram. The shape of the parallelogram is a variable that changes as the angles of the four-bar linkage vary.

The second member 30 in combination with the fourth member 34 and the first planar member 12 and the second planar member 36 forms a second "four-bar" mechanical type of a linkage, which also defines a second parallelogram.

The first parallelogram and the second parallelogram, each being attached to both the first planar member 12 and the second planar member 36, are therefore held in parallel relation with respect to each other. Accordingly, the plane of the first planar member 12 is always maintained in parallel relation to the plane of the second planar member 36.

Accordingly, the second planar member 36 is able to pivot toward the second end 16 of the first planar member 12 or away therefrom whilst always being maintained in parallel relationship thereto. This is an important achievement in that it ensures that the second planar member 36 will always be held parallel with respect to the plane of the ceiling where the first planar member 12 is attached and therefore also in parallel planar relationship thereto.

A second half of a mechanical latch 48 is attached to the same surface of the second planar member 36 as are the second ends of the first, second, third, and fourth members (18*b*, 30*b*, 32*b*, 34*b*).

The rack 10 is shown in the FIG. 1 drawing in a first position, ready for use, in solid lines. In the first position the second planar member 36 is maximally disposed away from the first planar member 12.

The rack 10 is shown in the FIG. 1 drawing in a second position, useful for non-obtrusive storage, in dashed lines. In the second position the second planar member 36 is disposed adjacent to the first planar member 12 and is considered to be in a retracted position.

When the rack 10 is pivoted, as is described in greater detail hereinafter, from the first position into the second position, the second half of a mechanical latch 48 aligns with the first half of a mechanical latch 28 so as to cooperatively engage each other. Once engaged by the first half of a mechanical latch 28, the second half of a mechanical latch 48 is held in position while the second planar member 36 is also held adjacent to the first planar member 12 in the second position. The first half of a mechanical latch 28 together with the second half of a mechanical latch 48 form a mechanical latch that retains the rack 10 in the retracted position until acted on by an operator (not shown).

A clothes receiving rack 50 is formed of any desired size and shape, shown presently as being generally rectangular in shape, and having a plurality of parallel members 52 each attached to a pair of end members 54.

The clothes receiving rack 50, although of any desired size and shape, is substantially a planar structure as well that is placed adjacent to an opposite surface of the second planar member 36 as to where the second ends of the first, second, third, and fourth members (18*b*, 30*b*, 32*b*, 34*b*) are attached.

The clothes receiving rack 50 is detachably attached to the second planar member 36 by an eye-bolt 56 which passes through a hole provided in the second planar member 36. A washer 58 is attached to the eye-bolt 56. The clothes receiving rack 50 is disposed intermediate the washer 58 and the second planar member 36 and is secured in position by tightening a nut (not shown) that cooperates with threads of the eye-bolt 56.

As can readily be seen, it is possible to substitute for the clothes receiving rack 50 a modified clothes receiving rack (not shown) having any desired size or shape thereto. This is useful to accommodate varying needs. For example, when the rack 10 is installed over laundry machines, in hallways, or in bathrooms, the clothes receiving rack 50 may optimally be formed of different sizes and shapes to better accommodate the space available in these different locations.

The ability to substitute a modified clothes receiving rack for the clothes receiving rack 50 is an important feature that increases the utility of the rack 10. This substitution can be accomplished at the factory at the time of manufacture or by a user (not shown) at the time of installation.

A handle 60 is pivotally attached to the eye-bolt 56 and extends down from the eye-bolt 56. The handle 60 is used to urge the rack 10 from the first position up into the second position for storage by simply pushing the handle 60 in an upward arc toward the first planar member 12 until the second half of a mechanical latch 48 engages with the first half of a mechanical latch 28.

Conversely, to urge the rack 10 down from the second position into the first position is accomplished by simply pulling the handle 60 in a downward arc until enough force is applied to release the second half of a mechanical latch 48 from a position of engagement with the first half of a mechanical latch 28.

In the second position the third and the fourth members 32, 34 align with the plane of the first planar member 12 and are disposed adjacent to the ceiling as are also the first and the second members 18, 30. The first and the second members 18, 30 are disposed adjacent to the first planar member 12 and the third and the fourth members 32, 34 are disposed on the side of the first and the second members 18, 30 that is furthest away from the first planar member 12.

This provides for an optimally compact structure when disposed in the second position as only the second planar member 36, the clothes receiving rack 50, the eye-bolt 56, the washer 58, and the handle 60 extend below the plane of the first planar member 12. This allows for use of the rack 10 to occur in areas having a minimal overhead clearance, such as in areas with only a seven foot high ceiling.

The compact storage of the rack in the second position also provides for a more pleasing appearance. Being especially compact, it is not obtrusive.

As mentioned hereinabove, the structure of the rack 10 positively maintains the second planar member 36 in parallel relation to the first planar member 12 at all times. This is an especially important attribute for a number of reasons.

First, it ensures that the clothes receiving rack 50, which is held adjacent to the second planar member 36 and therefore in parallel planar alignment with respect thereto, is also maintained in a parallel relation to the first planar member 12, and consequently to the ceiling as well. As the rack 10 is moved in an arc intermediate the first position and the second position the clothes receiving rack 50 is held parallel to the ceiling and, accordingly, is prevented from making contact with it. As the clothes receiving rack 50 is maintained parallel with respect to the ceiling, the rack 10 stores compactly in the second position.

Secondly, the clothes receiving rack 50 is maintained in parallel relation by positive engagement with the second planar member 36. This permits the clothes receiving rack 50 to be offset from center, as shown in the FIG. 1 drawing, if this is desired. It may be desirable to offset from the center of the second planar member 36 , the clothes receiving rack 50 to better adapt the rack 10 to the available space at hand.

The clothes receiving rack 50 is used to drape wet clothes (not shown) over the plurality of parallel members 52 and, if desired, over the pair of end members 54 for air drying. If the clothes receiving rack 50 is offset, the excessive weight of the clothes disposed on one side will attempt to tilt the clothes receiving rack 50 away from a parallel position.

This condition is prevented from occurring as described hereinabove because the second planar member 36 is securely held in parallel relation with respect to the first planar member 12 at all times and therefore the clothes receiving rack 50, if securely attached and maintained in parallel relation with the second planar member 36, must also be held in parallel relation with respect to the first planar member 12.

Similarly, the rack 10 is able to receive the modified clothes receiving rack which may be designed so as to be geometrically offset from the center of the second planar member 36 in any direction while maintaining it as well in parallel relation with respect to the first planar member 12.

Accordingly, the versatility and usefulness of the rack is increased by its ability to positively maintain, regardless of the load imparted by the weight of the wet clothes, the clothes receiving rack 50 in parallel relation even if the clothes receiving rack 50 is offset from center, and to also accept, as desired, the modified clothes receiving rack.

It is anticipated that many of the component parts of the rack 10 will be formed of plastic, possibly eliminating some of them. For example the hinges may be molded directly into the first planar member 12, the second planar member 36 and both ends of the first, second, third, and fourth members 18, 30, 32, 34. Accordingly, the mounting screws 38 may also be eliminated for each of the first, second, third, and fourth members 18, 30, 32, 34.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A clothes drying rack for attachment indoors to a structure, comprising:

(a) a first planar member, said first planar member having a length and a width and a thickness and including means for attaching said first planar member to said structure;

(b) at least three members, each of said at least three members pivotally attached about a first axis at one end thereof to said first planar member, each of said first axes being disposed a predetermined distance apart with respect to each other and having a longitudinal line of each of said first axes disposed in parallel relation with respect to each other;

(c) a second planar member, said second planar member pivotally attached about a second axis to each of said at least three members at an end opposite said one end thereof, each of said second axes being disposed a predetermined distance apart with respect to each other and having a longitudinal line of each of said second axes disposed in parallel relation with respect to each other and with respect to said first axes; and (d) a clothes receiving rack attached to said second planar member, wherein said second planar member is adapted to pivot to a first position that is maximally disposed away from said first planar member and to a second position that is disposed adjacent to said first planar member.

2. The clothes drying rack of claim 1 wherein said clothes receiving rack is detachably attached to said second planar member.

3. The clothes drying rack of claim 1 wherein said at least three members includes four members.

4. The clothes drying rack of claim 1 wherein said planar member includes a first end having a first width and a second end having a second width wherein said first width is greater than said second width.

5. The clothes drying rack of claim 4 wherein said first width is greater than said second width by at least two times the thickness of any of said at least three members.

6. The clothes drying rack of claim 4 wherein said first width is greater than said second width by at least the combined thickness of any two of said at least three members.

7. The clothes drying rack of claim 4 wherein said means for attaching includes at least one hole formed through said first planar member.

8. The clothes drying rack of claim 7 wherein said at least one hole includes a second hole forming a first pair of holes, each of said first pair of holes being disposed an equivalent distance from said first end.

9. The clothes drying rack of claim 8 including a second pair of holes, each of said second pair of holes being disposed an equivalent distance from said first pair of holes.

10. The clothes drying rack of claim 9 wherein said second pair of holes is disposed sixteen inches from said first pair of holes.

11. The clothes drying rack of claim 9 wherein said second pair of holes is disposed twenty-four inches from said first pair of holes.

12. The clothes drying rack of claim 1 including means for retaining said second planar member in said second position.

13. The clothes drying rack of claim 12 wherein said means for retaining includes a first half of a latch attached to said first planar member and a second half of a latch attached to said second planar member wherein when said second planar member is disposed in said second position, said second half of a latch is adapted to cooperatively engage with said first half of a latch to retain said second planar member in said second position.

14. The clothes drying rack of claim 1 wherein each of said second axes includes a hinge, each of said hinges attached to said opposite end of each of said at least three members and also to said second planar member.

15. The clothes drying rack of claim 1 including means for attaching said clothes receiving rack to said second planar member.

16. The clothes drying rack of claim 15 wherein said means for attaching said clothes receiving rack includes at least one bolt passing through a hole formed in said second planar member, said at least one bolt adapted to cooperatively engage with said clothes receiving rack.

17. The clothes drying rack of claim 16 including at least one washer disposed over said at least one bolt and having said clothes receiving rack disposed intermediate said washer and said second planar member.

18. The clothes drying rack of claim 16 wherein said at least one bolt includes an eye-bolt.

19. The clothes drying rack of claim 18 including a handle, said handle pivotally attached to an eye of said eye-bolt.

20. The clothes drying rack of claim 1 including a handle, said handle adapted to urge said clothes drying rack alternately from said first position to said second position.

* * * * *